United States Patent [19]

Binks et al.

[11] Patent Number: 4,504,195

[45] Date of Patent: Mar. 12, 1985

[54] JET PUMP FOR OIL WELLS

[75] Inventors: Richard H. Binks, Fullerton; Frederick C. Christ, Long Beach, both of Calif.

[73] Assignee: Armco Inc., Middletown, Ohio

[21] Appl. No.: 506,000

[22] Filed: Jun. 20, 1983

Related U.S. Application Data

[63] Continuation-in-part of Ser. No. 279,086, Jun. 30, 1981, abandoned.

[51] Int. Cl.[3] ..... F04F 5/00

[52] U.S. Cl. ..... 417/172

[58] Field of Search ..... 417/87, 151, 167, 172, 417/184, 198, 189, 191, 358; 166/106

[56] References Cited

U.S. PATENT DOCUMENTS

| | | | |
|---|---|---|---|
| Re. 21,893 | 9/1941 | Horvath | 417/172 |
| 2,468,642 | 4/1949 | Shallenberg | 417/198 X |
| 2,489,636 | 11/1949 | Gurley | 417/198 X |
| 2,812,723 | 11/1957 | Coberly | 417/189 |
| 2,851,954 | 9/1958 | Coberly | 417/358 |
| 2,869,470 | 1/1959 | Coberly | 417/358 |
| 3,043,107 | 7/1962 | Magnus, Jr. | 417/184 |
| 3,059,581 | 10/1962 | Coberly et al. | 417/358 |
| 3,551,074 | 12/1970 | Stout | 417/172 |
| 3,666,378 | 5/1972 | Bloudoff | 417/358 |
| 3,687,573 | 8/1972 | McArthur et al. | 417/358 |
| 4,135,861 | 1/1979 | Brown et al. | 417/172 |
| 4,285,638 | 8/1981 | Clark | 417/172 |

FOREIGN PATENT DOCUMENTS

| | | | |
|---|---|---|---|
| 2107397 | 4/1983 | United Kingdom | 417/151 |

*Primary Examiner*—William L. Freeh
*Assistant Examiner*—Paul F. Neils
*Attorney, Agent, or Firm*—Frost & Jacobs

[57] ABSTRACT

A fluid operated pump system which includes power fluid supply means comprising either the annulus between well casing and production tubing, or a secondary tubing, and a production tubing, set in a well, the production tubing having a housing at the lower end with which the power fluid supply means communicates. A pump unit, including a fluid operated jet pump, is movable downwardly through the production tubing into the housing to a fixed location and maintained at the fixed location by the forces of gravity and friction. The pump is operable in the housing by operating fluid under pressure supplied through the power fluid supply means to pump fluid from the well into the production tubing. A cavity is provided at the lower end of the pump unit between two balanced seals. The cavity communicates with the power fluid supply means and with the fluid operated jet pump. Power fluid introduced into the cavity causes no net force to be exerted on the pump unit. When pumping action takes place, produced fluids are taken from a lower pressure area below the pump unit and boosted to a higher pressure area above the pump unit by the fluid operated jet pump, resulting in a net downward force on the pump unit to cause the pump unit to be restrained against its fixed location without the need of latch means.

7 Claims, 7 Drawing Figures

JET PUMP FOR OIL WELLS

REFERENCE TO RELATED APPLICATION

This application is a continuation-in-part of copending application Ser. No. 279,086, filed June 30, 1981 now abandoned.

BACKGROUND OF THE INVENTION

The present invention relates in general to fluid-operated oil well pumping systems of the type wherein a pump unit which includes a fluid operated pump is circulated into and out of its operating position in a well. More particularly, the invention relates to an open system wherein the production fluid discharged by the pump and the spent operating fluid discharged thereby are mixed together and conducted to the surface through a common, production tubing. Operating fluid under pressure for actuating the fluid operated pump is delivered thereto through a parallel supply conduit, or through the annulus between the well casing and the production tubing.

Still more specifically, the present invention contemplates a fluid operated pump system which is of the reverse circulation type wherein the pump is circulated into and out of the well through a production tubing which is relatively large, and wherein the operating fluid is delivered to the pump through a parallel supply tubing which is relatively small or through the annulus between the well casing and the production tubing. Such a reverse circulation system has the advantage of minimizing fluid friction since the combined flow of production fluid and spent operating fluid is conducted to the surface through the larger production tubing, the smaller flow of operating fluid under pressure being conducted downwardly to the pump through the smaller supply tubing or through the annulus.

With such a reverse circulation system, prior art pump units are normally run in by introducing fluid under pressure into the production tubing thereabove, and the pump unit is circulated out by introducing fluid under pressure there beneath through the return conduit. Since the supply conduit contains operating fluid under high pressure during normal operation of the fluid operated pump when the pump unit is in its housing at the lower end of the production tubing, latch means are provided for preventing upward circulation of the pump unit through the production tubing of the pump unit during normal operation of the fluid operated pump.

Prior art attempts to improve upon fluid operated pump systems of the reverse circulation type have always seemed to require the use of a complicated latch means. U.S. Pat. No. 2,869,470, granted Jan. 20, 1959 to Clarence J. Coberly, is exemplary of patents disclosing latch means for latching the pump unit in its operating position against the upward bias resulting from the application of the operating fluid under pressure in the supply tubing to the lower end of the pump unit. After the pump unit arrives in its operating position in the housing at the lower end of the production tubing, the latch means is set by gradually building up the operating fluid pressure in the supply conduit, frictional resistance being sufficient to prevent upward displacement of the pump unit before the latch means is set as long as the operating fluid pressure is increased slowly. When it is desired to circulate the pump unit out through the production tubing, the latch means is released by increasing the pressure in the production tubing. The Coberly pump unit can be latched and unlatched hydraulically by selective pressure applications to the latch means. However, malfunctioning of the hydraulically operated latch means makes it extremely difficult to set or release the pump unit. If the pump unit cannot be latched in its operating position, it must be circulated out and repaired or replaced. On the other hand, if the latch means cannot be released, due to the effects of corrosion, sand accumulations, or the like, it may be necessary to pull the entire tubing system.

U.S. Pat. No. 3,687,573, granted Aug. 29, 1972 to Ralph F. McArthur, et al is an example of prior art attempts to provide a mechanically actuated latch means as opposed to the Coberly hydraulically actuated latch means.

SUMMARY OF THE INVENTION

The present invention provides a improved fluid operated pump system of the open type which provides a retrievable jet pump which does not require latch means or hold down devices to maintain the pump unit from upward circulation through the production tubing during normal operation of the fluid operated pump.

According to the present invention, the pump unit is circulated into its bottom hole cavity to a fixed location against a "no go" diameter and retained in this location due to the forces of gravity and friction. A cavity is provided in the lower end of the pump unit between two balanced or same diameter seals. The sealed cavity communicates with the power fluid supply means and with the fluid operated jet pump. When power fluid is introduced into the sealed cavity no net force is exerted on the pump unit. When pumping action takes place, produced fluids are taken from a lower pressure area below the pump unit and boosted to a high pressure area above the pump unit by the nozzle or jet means, resulting in a net downward force on the pump unit, which is restrained in its fixed location. Accordingly, the pump unit does not need latch means to stay in place.

According to the present invention, the power fluid supply means may comprise either secondary tubing or the annulus between well casing and production tubing.

Since jet pumps operate inefficiently returning fluids in a small tubing string because of added discharge pressure, primary or production returning fluids are usually returned in the annulus between the well casing and tubing. However, off shore production practices prohibit production flowing against the casing because of corrosion, etc. The present invention solves this problem by conducting treated power fluid down the annulus, or secondary tubing, returning the combined spent power fluid and production up the primary tubing.

BRIEF DESCRIPTION OF THE DRAWINGS

FIGS. 2A and 2B show a fragmentary, longitudinal cross sectional view of the jet pump of the present invention illustrating the nozzle, throat and defuser thereof.

FIG. 2C shows how FIGS. 2A and 2B interrelate.

DESCRIPTION OF THE PREFERRED EMBODIMENT

Figure 1:
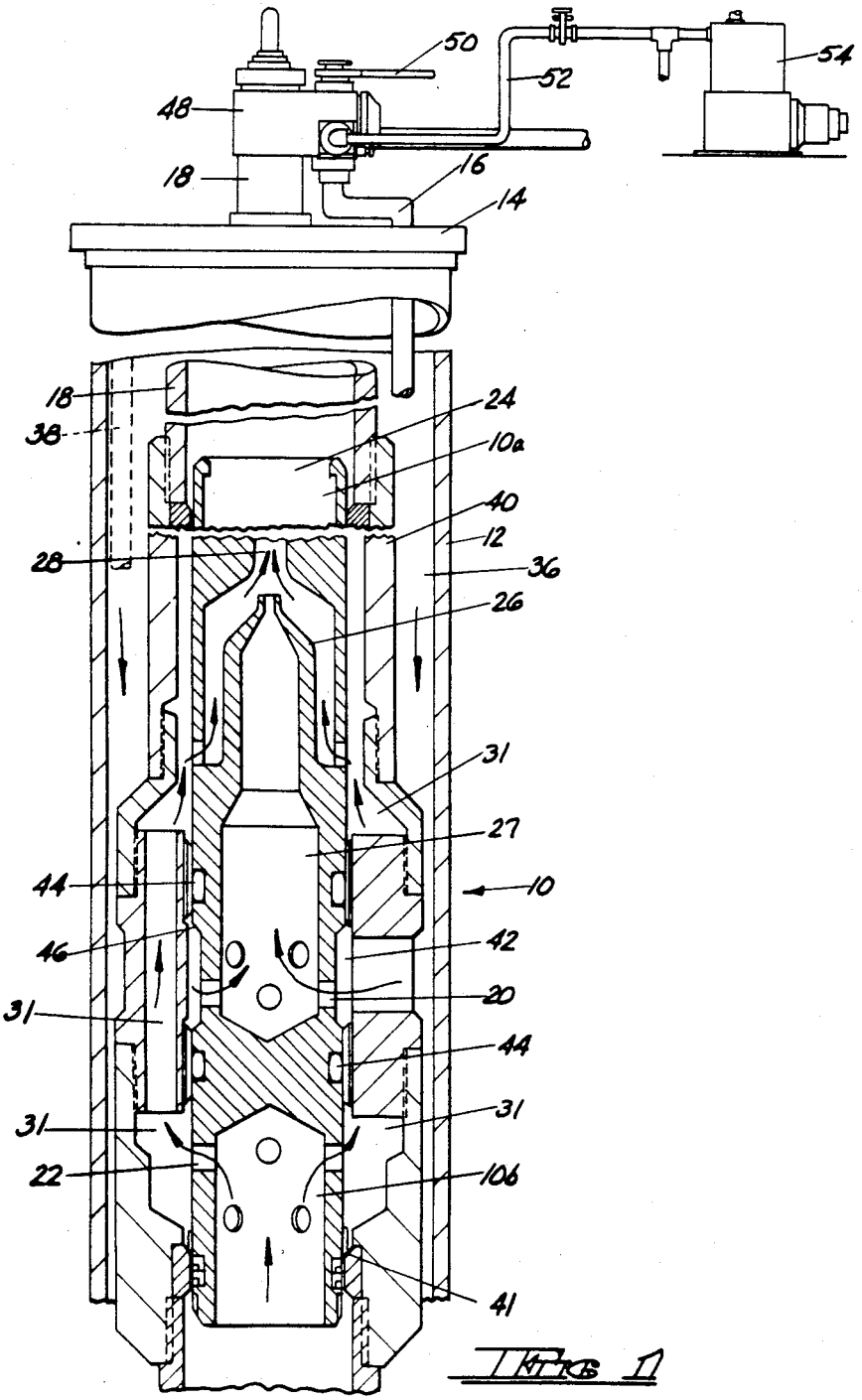
FIG. 1 comprises a semi-diagrammatic view of a fluid operated well pump of the jet type incorporating the improvement of the present invention.

In most installations, a packer (not shown) is set below the pump, but above the perforations effecting a seal between the supply tubing and the casing. The mixture of spent power fluid and pumped well fluid is then returned upwardly to the surface in the annulus between the well tubing and the casing. However, as previously indicated, off shore production practices prohibit production flowing against the casing because of corrosion, etc. Alternatively, a reverse flow circulation can satisfy this restriction by flowing treated power fluid in the annulus between casing and return mixed produced fluid in the primary tubing to the wellhead. The latter alternative is shown in FIG. 1 which illustrates a well pump 10 of the jet type in a casing 12 provided at its upper end with a casing head 14 which supports the production and the supply tubings 18 and 16, respectively. The supply tubing 16 conveys operating or power fluid, such as, for example, clean crude oil, downwardly under pressure into the well to the pump 10. The production tubing 18 conveys a mixture of spent power fluid and pumped well fluid or production fluid upwardly to the surface.

As can be seen, the upper and lower ends **10*a* and 10*b*, respectively, of the pump 10 are oriented generally vertically in a housing 40 at the lower end of the production tubing 18 in the well casing 12, with the upper end 10*a* thereof uppermost when the pump 10 is in its operating position in well casing 12. The pump 10 is provided with an intake 20 at the lower end 10*b* thereof for the operating or power fluid under pressure, with an inlet 22 for the well fluid, and with an outlet 24 at the end 10*a* for the combination of fluid produced by the well and spent operating or power fluid. Nozzle or jet means 26, which is directed upwardly when the pump 10 is in its operating position in the well casing 12, communicate through the passages 27 and 28 with the intake 20 and the outlet 24, respectively, and discharge into the throat 30, through the defuser 32 and into outlet 24 leading to the production tubing 18**.

Figures 2A, 2C:
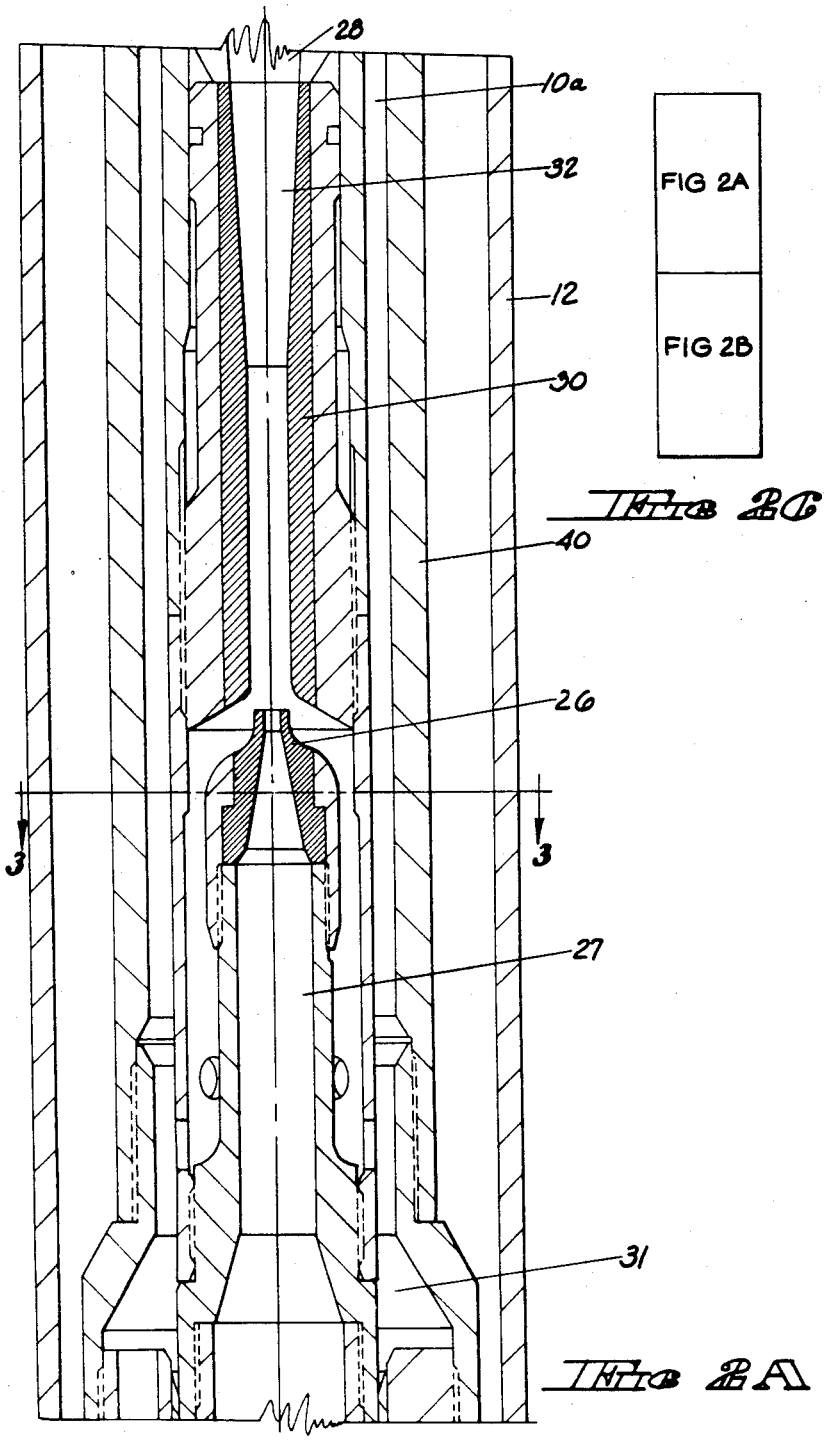
Figure 2D:
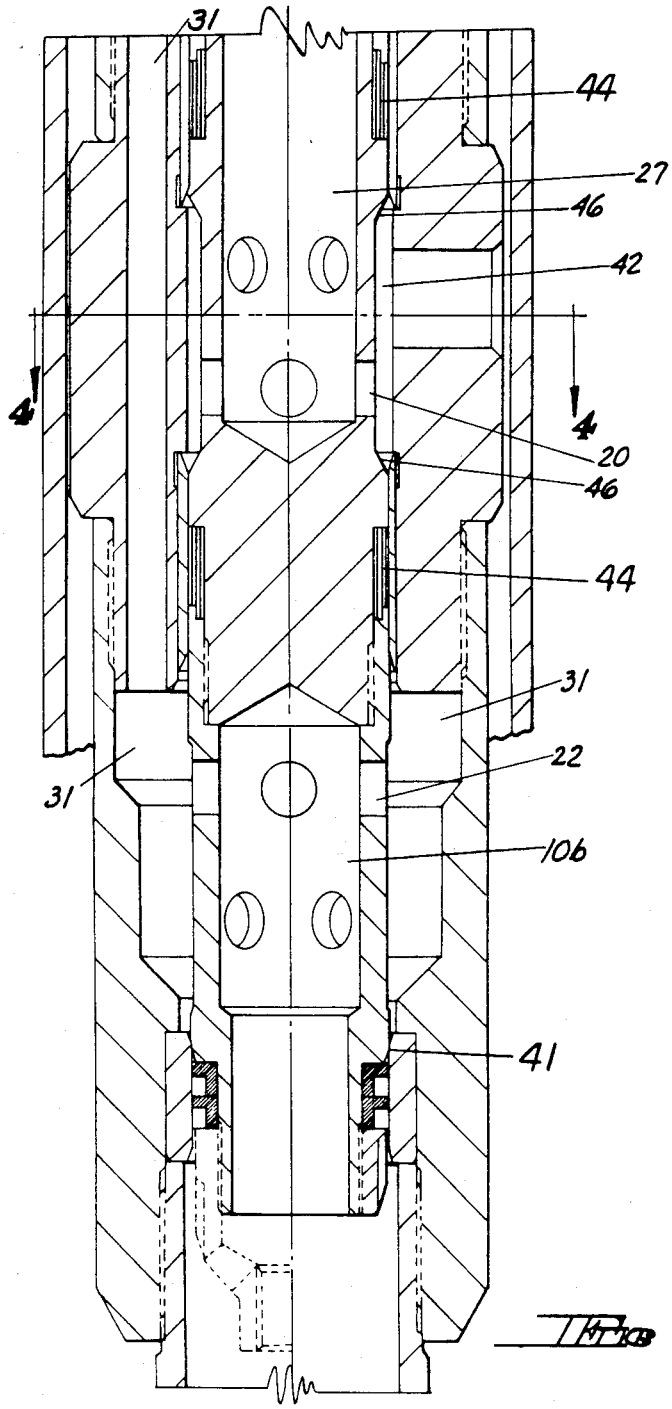
FIG. 2D is a greatly enlarged view of a portion of FIG. 2B.
Figure 3D:
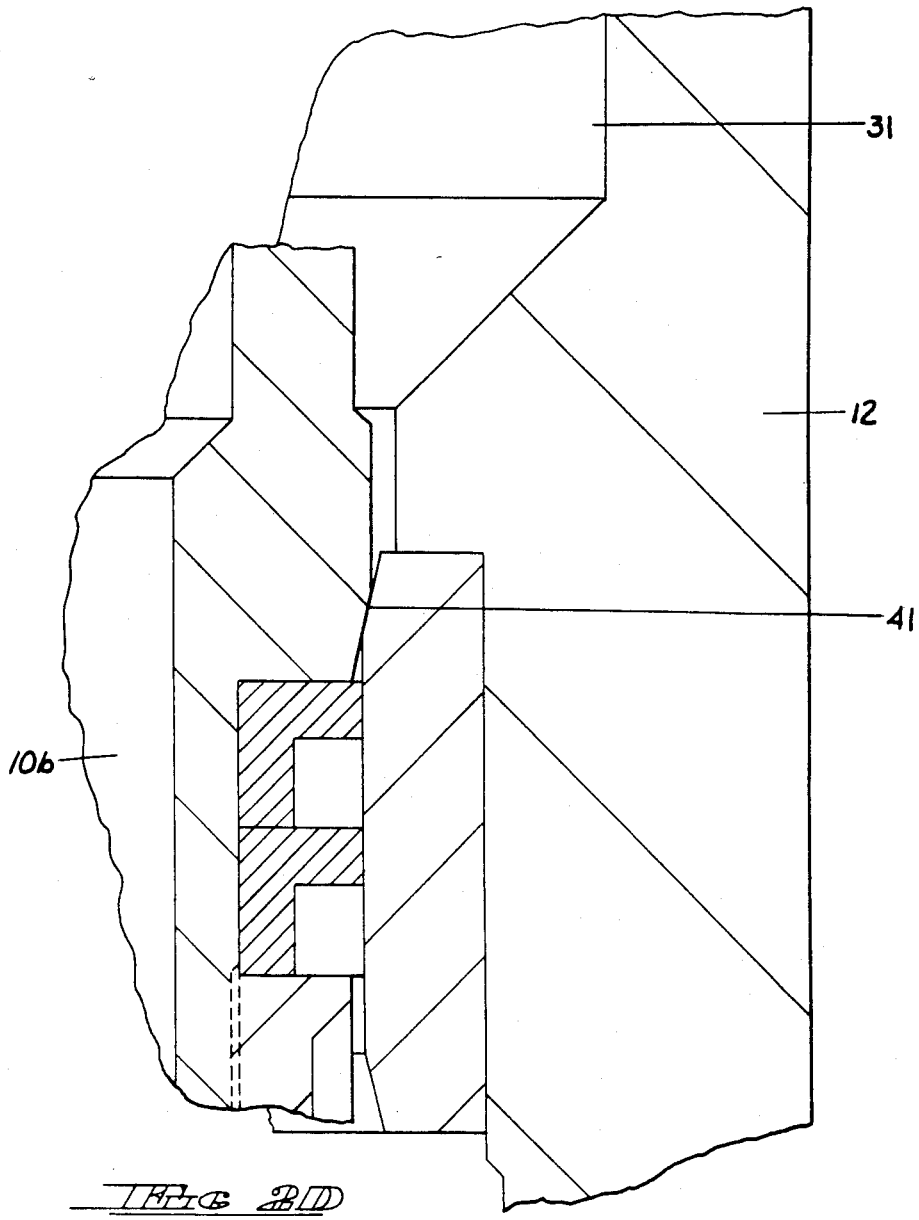
FIG. 3 is a cross sectional view taken on the line 3—3 of FIG. 2A.
Figure 3:
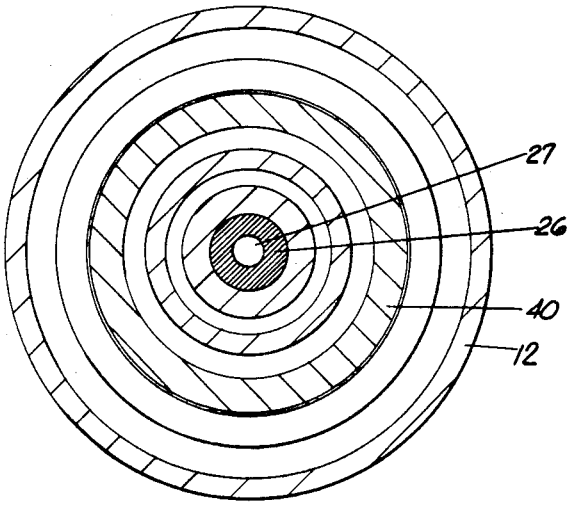
Figure 4:
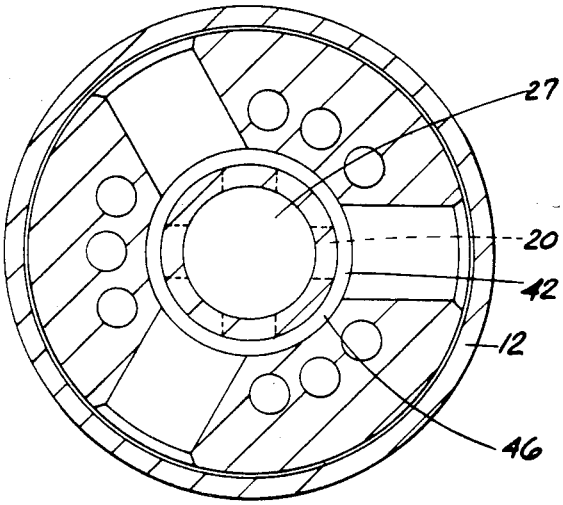
FIG. 4 is a cross sectional view taken on the line 4—4 of FIG. 2B.

As can best be seen in FIGS. 1 and 2B, fluid from the well is brought upward from the inlet 22 in a generally vertical direction through the passages 31 connecting the inlet 22 to the nozzle or jet means 26, avoiding a reversal of direction, and entrained in the high velocity jet stream of operating or power fluid emerging from the nozzle or jet means 26. The combined fluids are carried into the throat 30, and then into the defuser 32, and the combination of fluids are pumped upward in a generally vertical direction through the passage 28 connecting the defuser 32 to the outlet 24 by the energy imparted by the operating fluid emerging from the nozzle 26. The throat 30 is provided with a generally constant bore section.

The power fluid supply means may comprise the annulus 36 between the well casing 12 and the production tubing 18, or it may comprise a secondary tubing 38 shown in dashed lines. The production tubing 18 is provided with a housing 40 at the lower end thereof with which are power fluid supply means, either through the annulus 36 or the secondary tubing 38, communicates.

The pump unit, including a fluid operated pump 10, is movable downwardly through the production tubing 18 into housing 40, where it is restrained against the "no go" diameters 41. The pump unit will remain in this location due to the forces of gravity and friction between the pump unit and the area of reduced diameter. The pump is operable in the housing 40 by operating fluid under pressure supplied through the power supply means to pump fluid from the well into the production tubing 18.

A sealed cavity 42 is provided at the lower or downwardly facing end **10*b* of the pump 10. The cavity 42 communicates with the power fluid inlet 20 and with the passage 27 leading to the jet means 26. The cavity 42 is sealed by means of the same diameter teflon seals 44 on either side thereof. The cavity 42 is provided with lands 46 thereon which help to balance the hydraulic forces and aid in maintaining the fluid operated pump 10 in place in the housing 40** during production.

It will, of course, be understood that during operation the supply and production tubing 16 and 18, respectively, are connected at their upper ends to a valve head 48. The valve head 48 is provided with valve means (not shown) controlled by handle 50 for diverting operating or power fluid under pressure, which is supplied to the valve head 48 through a line 52 by a pump 54, into either the supply tubing 16 or the production tubing 18. Normally, when the well pump 10 is in operation as hereinbefore described, the handle 50 is positioned so that valve means in the valve head 48 delivers the operating or power fluid under pressure into the supply tubing 16, and then either through the annulus 36 between the well casing 12 and the production tubing 18, or through the secondary tubing 38 to operate the well pump 10. The pump 10 can be made operational in the housing 40 of the production tubing 18 in the well casing 12 by releasing it and allowing it to circulate downwardly by means of gravity, aided by fluid flow, or by attaching it to a well known locomotive device which seals to the inside of the tubing 18, in which case the fluid flow pushes the pump 10 down the tubing 19. the pump 10 may be retrieved from the well by means of a well known retrieving tool which circulates the pump 10 out of its desired position.

As previously indicated herein, normal hydraulic installations conduct power fluid down the primary tubing and return power fluid and production up the annulus or a secondary tubing string. Jet pumps operate inefficiently returning fluids in a small tubing string because of added discharge pressure, usually returning fluids in the annulus between the well casing and the production tubing. Off shore production practices prohibit production flowing against the casing because of corrosion, etc. The present invention conducts the treated power fluid down the annulus 36, or secondary tubing 38, returning the production fluid and spent power fluid up the primary tubing 18.

The present invention provides a retrievable jet pump 10 wherein controlled power fluid is against the well casing 12. Gas will lighten the return fluid. The pump 10 of the present invention may be utilized with simple equipment for production test. Furthermore, drilling pumps can be used for power. An intake pressure recorder can also be utilized.

The pump unit 10 of the present invention does not require latch means to stay in place when pump 10 is circulated into its bottom hole cavity 42 a pressure increase indicates that the pump 10 is in place, restrained against the "no go" diameters 41 and retained in this location due to the forces of gravity and friction. Reversing the direction of fluid circulation to normal operation, fluid is introduced through the inlet 20 into the cavity 42 between the two balanced or same diameter seals 44, and no net force is exerted on the pump 10. When pumping action takes place, produced fluids are taken from a lower pressure area below the pump 10 and boosted to a higher pressure area above the pump 10 by the nozzle or jet means 26. This results in a net downward force on the pump 10, which is restrained by the "no go" diameters 41.

It will be understood that various changes, modifications and substitutions may be incorporated in the particular embodiment of the invention herein disclosed without departing from the spirit of the invention and defined by the claims which follow.

What is claimed is:

1. In a fluid operated free pump system, the combination of: supply and production tubings set in a well and connected at their lower ends to a housing, said housing having an area of reduced diameter; a fluid operated free pump unit, including a fluid operated jet pump, said pump unit being movable downwardly through said production tubing to said area of reduced diameter and being maintained at said area of reduced diameter by the forces of gravity and friction between said pump unit and said area of reduced diameter and being operable in said housing by operating fluid under pressure from said supply tubing to discharge production fluid into said production tubing; and a cavity at the lower end of said pump unit, said cavity being located between two balanced seals and communicating with said supply tubing and with said fluid operated pump, power fluid introduced into said cavity causing no net force to be exerted on said pump unit, whereby when pumping action takes place, produced fluids are taken from a lower pressure area below said pump unit and boosted to a higher pressure area above said pump unit, resulting in a net downward force on said pump unit to cause said pump unit to be restrained against said area of reduced diameter.

2. In a fluid-operated free pump system in a well casing, the combination of:

(a) power fluid supply means comprising a production tubing and one of the annulus between said well casing and said production tubing, on the one hand, and a secondary tubing, on the other hand, said power fluid supply means being set in a well, said production tubing having a housing at the lower end thereof with which said power fluid supply means communicates, said housing having an area of reduced diameter;

(b) a pump unit, including a fluid operated jet pump, said pump unit being movable downwardly through said production tubing to said area of reduced diameter and being maintained at said area of reduced diameter by the forces of gravity and friction between said pump unit and said area of reduced diameter, said pump unit being operable in said housing by operating fluid under pressure supplied through said power fluid supply means to pump fluid from the well into said production tubing; and (c) a cavity at the lower end of said pump unit, said cavity being located between said two balanced seals and communicating with said power fluid supply means and with said fluid operating jet pump, power fluid introduced into said cavity causing no net force to be exerted on said pump unit, whereby when pumping action takes place, produced fluids are taken from a lower pressure area below said pump unit and boosted to a higher pressure area above said pump unit by said fluid operated jet pump, resulting in a new downwardly force on said pump unit to cause said pump unit to be restrained against said area of reduced diameter.

3. The pump system according to claim 2 wherein said power fluid supply means comprises secondary tubing.

4. The pump system according to claim 2 wherein said power fluid supply means comprises the annulus between said well casing and said production tubing.

5. In a fluid-operated jet pump system of the open type wherein the production fluid discharged by the pump and spent operating fluid discharged thereby are mixed together and conducted to the surface through a common production tubing in a well casing, the combination of:

(a) power fluid supply means comprising a production tubing and one of the annulus between said well casing and said production tubing, on the one hand, and a secondary tubing, on the other hand, said power fluid supply means being set in a well, said production tubing having a housing at the lower end thereof with which said power fluid supply means communicates, said housing having an area of reduced diameter;

(b) a pump unit, including a fluid operated jet pump, said pump unit being movable downwardly through said production tubing to said area of reduced diameter and being maintained at said area of reduced diameter by the forces of gravity and friction between said pump unit and said area of reduced diameter, said pump unit being operable in said housing by operating fluid under pressure supplied through said power fluid supply means to pump fluid from the well into said production tubing; and (c) a cavity at the lower end of said pump unit, said cavity being located between two balanced seals and communicating with said power fluid supply means and with said fluid operating jet pump, power fluid introduced into said cavity causing no net force to be exerted on said pump unit, whereby when pumping action takes place, produced fluids are taken from a lower pressure area below said pump unit and boosted to a higher pressure area above said pump unit by said fluid operated jet pump, resulting in a net downward force on said pump unit to cause said pump unit to be restrained against said area of reduced diameter.

6. The pump system according to claim 5, wherein said power fluid supply means comprises secondary tubing.

7. The pump system according to claim 5, wherein said power fluid supply means comprises the annulus between said well casing and said production tubing.

* * * * *